US010251250B2

(12) United States Patent
Vangeel et al.

(10) Patent No.: US 10,251,250 B2
(45) Date of Patent: Apr. 2, 2019

(54) LIGHTING SYSTEM FAULT DIAGNOSTIC APPARATUS

(71) Applicant: SIGNIFY HOLDING B.V., Eindhoven (NL)

(72) Inventors: Jurgen Mario Vangeel, Beerse (BE); John André Van Beurden, Tilburg (NL); Robbert Martinus Andreas Driessen, Hegelsom (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/579,723

(22) PCT Filed: May 30, 2016

(86) PCT No.: PCT/EP2016/062118

§ 371 (c)(1),
(2) Date: Dec. 5, 2017

(87) PCT Pub. No.: WO2016/193199

PCT Pub. Date: Dec. 8, 2016

(65) Prior Publication Data

US 2018/0177035 A1 Jun. 21, 2018

(30) Foreign Application Priority Data

Jun. 5, 2015 (EP) ..... 15170792

(51) Int. Cl.
*H05B 37/03* (2006.01)
*H05B 33/08* (2006.01)

(52) U.S. Cl.
CPC ..... *H05B 37/03* (2013.01); *H05B 33/089* (2013.01)

(58) Field of Classification Search
None
See application file for complete search history.

(56) References Cited

U.S. PATENT DOCUMENTS 9,789,332 B2 * 10/2017 Liu ..... A61B 18/203
9,965,007 B2 * 5/2018 Amelio ..... G06F 1/26
(Continued)

FOREIGN PATENT DOCUMENTS

EP 2073608 * 6/2009
EP 2073608 A1 6/2009
(Continued)

*Primary Examiner* — Crystal L Hammond
(74) *Attorney, Agent, or Firm* — Meenakshy Chakravorty

(57) ABSTRACT

A diagnostic apparatus (101) for diagnosing faults within a lighting system comprising at least one luminaire (121), and at least one presence sensor (123, 151) configured to control the operation of at least one luminaire (121) when an object is within the presence sensor (123, 151) sensing range, the diagnostic apparatus (101) comprising: a user input (103) configured to receive at least one input to control the at least one luminaire (121); and a fault determiner (221) configured to determine at least one lighting system fault based on the at least one input and wherein an object is within the sensing range of a presence sensor (123, 151) expected to be associated with the at least one luminaire (121); and a fault reporter (223) configured to generate at least one fault report based on the determined at least one lighting system fault.

15 Claims, 4 Drawing Sheets

(56) References Cited

U.S. PATENT DOCUMENTS

| | | | | |
|---|---|---|---|---|
| 2009/0185397 | A1* | 7/2009 | Forghani-zadeh | H02M 1/36 363/18 |
| 2010/0277333 | A1* | 11/2010 | Van De Sluis | F21V 23/0442 340/686.1 |
| 2011/0062872 | A1 | 3/2011 | Jin et al. | |
| 2012/0143357 | A1 | 6/2012 | Chemel et al. | |
| 2012/0169245 | A1* | 7/2012 | Chen | H02M 3/33523 315/223 |
| 2014/0239817 | A1 | 8/2014 | Leinen et al. | |
| 2015/0130355 | A1 | 5/2015 | Rains, Jr. et al. | |
| 2016/0323949 | A1* | 11/2016 | Lee | H05B 33/0845 |

FOREIGN PATENT DOCUMENTS

| | | | |
|---|---|---|---|
| JP | 2012155874 | * | 8/2012 |
| JP | 2012155874 | A | 8/2012 |

* cited by examiner

LIGHTING SYSTEM FAULT DIAGNOSTIC APPARATUS

CROSS-REFERENCE TO PRIOR APPLICATIONS

This application is the U.S. National Phase application under 35 U.S.C. § 371 of International Application No. PCT/EP2016/062118, filed on May 30, 2016, which claims the benefit of European Patent Application No. 15170792.4, filed on Jun. 5, 2015. These applications are hereby incorporated by reference herein.

TECHNICAL FIELD

The present disclosure relates to lighting system fault diagnostic apparatus and methods for diagnosing faults within a lighting system.

BACKGROUND

Digital lighting technologies, i.e. illumination based on semiconductor light sources, such as light-emitting diodes (LEDs), offer a viable alternative to traditional fluorescent, HID, and incandescent lamps. LEDs offer many advantages, including controllability, high energy conversion and optical efficiency, durability, and lower operating costs. Recent advances in controllable LED technology have provided efficient and robust full-spectrum lighting sources that enable a variety of lighting effects in many applications.

Alongside the development of controllable LEDs, rapid developments have been made in the area of sensor technologies. Sensors todays are not only able to effectively measure natural illumination and occupancy, but have also become significantly smaller, and therefore able to easily fit inside small devices, including devices housing controllable LEDs and cameras. For example, existing natural illumination based lighting control systems are able to employ individually controllable luminaires with dimming ballasts as well as one or more natural illumination photo sensors to measure the average workplane illumination within a naturally illuminated space. In such systems, one or more controllers, in order to respond to daylight egress and maintain a minimum workplane illumination, may monitor the output of one or more photosensors and control illumination provided by the luminaires.

More recently, innovations in the realms of wireless communication and smart mobile devices have launched a generation of smart phones and tablet computers with unparalleled mobility and computational power. For example, mobile smart phones with access to applications on cloud servers are able to gather, and process data from their immediate environments in real time. Additionally, location-based services allow for the customization of information delivered to mobile devices. Smart mobile devices, used in conjunction with controllable LEDs and appropriate sensors can therefore be used to customize illumination in physical spaces in real time.

Two further significant technological developments present further opportunities for innovations in the area of environmental management and control: Power over Ethernet (PoE) and Coded Light (CL). PoE allows for the delivery of electrical power along with data over a single cable to devices such as lighting devices, IP cameras or wireless access points. The advent of PoE technology makes it feasible to power devices in remote locations within building structures, by significantly reducing the need for electricians to install conduit, electrical wiring, and outlets. Unlike other devices, the potential location of a PoE device is not limited based on the placement of AC outlets within a structure. For example, PoE allows wireless LAN access points to be placed on ceilings for more optimal RF reception.

CL technology can be used to embed unique identifiers, or codes, into the light output from different light sources. Using these identifiers, the light emanating from a specific light source can be differentiated even in the presence of illumination contributions from multiple other light sources. CL can therefore be used to identify and locate individual light sources and devices relative to other such sources and devices. The use of light as a means for device identification, location and communication opens the door to innovative systems and methods for managing environmental conditions by allowing fine-grained interactions between devices such as individually controllable LEDs, sensors, and control devices such as smart phones that were not previously feasible.

These technologies may be combined in an 'intelligent luminaire'. In other words an intelligent luminaire may be a luminaire that consists of a lighting unit, one or more (connections to) sensors and a microcontroller which is executing some logic/intelligent behavior, and has some communications means to interface with an area controller or directly with one or more neighboring luminaires.

As these luminaires become more and more complex, the control logic (formed from a combination of hardware and software elements) needed to control these luminaires also becomes increasingly complex. Furthermore a lighting system comprising the intelligent luminaires may further comprise sensors which also have microcontrollers on board (for example occupancy sensors which may be equipped with algorithms and software to accurately determine occupancy of a room or space). This may lead to situations where partial failures may be difficult to detect or diagnose.

Furthermore the distributed nature of such lighting systems (comprising intelligent luminaires and intelligent sensors) may further leads to difficulty in analyzing and diagnosing problems, or even detecting faults or failures within the system. For example because of the nature of most modern systems a single defective sensor in an open office consisting of many intelligent luminaires with each having a sensor, may not be easily detected provided there is sufficient occupancy in the open office. (In other words as long as one of the sensors is triggered, it should result in occupancy for the entire room being determined and the lights controlled to be on)

SUMMARY

The following provides a technique for diagnosing a lighting system for faults. It is based on the principle that a fault can be determined when a user input is received to control a light output characteristic of a luminaire, wherein this user input not being expected due to the lighting system comprising a presence sensor that should have already triggered based on the detected presence of the user the control of a light output characteristic of the luminaire. As an example, a user may press a wall switch which is located within a sensing range of a presence sensor. When the presence sensor is to turn on the luminaire when presence is detected, then a user turning the luminaire on with the wall switch is indicative of the luminaire not having been turned on based on the presence sensor being triggered. The cause of such a malfunction could, for example, lie in the presence sensor malfunctioning, the communications between the presence sensor and the luminaire (controller) failing or the luminaire being broken. As a further example, the user may turn on a luminaire using an application on a smart phone. The user would typically be near the luminaire and within the sensing range of the presence sensor when doing so. As a first example, when a tag (e.g. RFID, barcode) is scanned using the application on the smart phone to control the luminaire and such a tag is present near the luminaire. As a second example, an image of the luminaire can be captured by a camera in the smart phone to determine that the user is indeed near (e.g. standing underneath) the luminaire. In such a scenario, the use of the smart phone to turn on the luminaire which should have already be on based on presence detection is another example of a fault detection. When a smart phone is used, the camera can capture an image which is analysed to extract further information, such as the color or intensity of the light emitted by the luminaire. Such information can be compared to the expected light output characteristic of the luminaire, as determined by the user input provided via the smart phone or as determined by the scene setting triggered by the presence sensor.

Depending on the application, the diagnosis may result in a report being generated and transmitted to a building management server to enable repair or reconfiguration of the lighting system to avoid any failure from having a critical effect on the operation of the lighting system.

According to one aspect disclosed herein, there is provided a diagnostic apparatus for diagnosing faults within a lighting system. The lighting system comprising a luminaire and a presence sensor, wherein the presence sensor is configured to control a light output characteristic of the luminaire based on detecting an object within a sensing range. The diagnostic apparatus comprises:

an interface configured to receive, from a user, an input to control the luminaire, wherein the received input is indicative of the user being within the sensing range of the presence sensor, a fault determiner configured to determine a lighting system status and a lighting system fault, wherein the lighting system fault is based on the received input and the determined lighting system status; and a fault reporter configured to generate a fault report based on the determined lighting system fault.

The user input can be indicative of the user being within the sensing range of the presence sensor based on, for example, the user input being received through a wall switch located within the sensing range, or the user input being received through a smart phone that has detected the luminaire (e.g. via image recognition, comparing positioning data of the smart phone to positioning data of the luminaire, presence of a beacon signal, or via detecting coded light emitted by the luminaire), the luminaire (e.g. the light footprint in which the user would be present) being within the sensing range.

The lighting system status can comprise, for example, the current light output characteristic of the luminaire (e.g. luminaire is on, luminaire is off, the intensity or color of light emitted), a status of the presence sensor (e.g. presence detected, presence not detected), a status of the communications within the system (e.g. message received from presence sensor, message received at luminaire), etc.

Thus in such embodiments the diagnostic apparatus may be able to determine various types of lighting system faults as the user input would indicate a fault has occurred, for example in the sensor or in the luminaire failing to provide light when expected.

The diagnostic apparatus may further comprise: a sensor determiner configured to determine a status of the at least one presence sensor, wherein the fault determiner is configured to determine a type of lighting system fault based on a sensor determiner output and the at least one input.

The fault determiner may be configured to determine a presence sensor fault when the sensor determiner output fails to produce an output indicating the presence sensor, expected to be associated with the at least one luminaire, detects the object within the presence sensor sensing range.

In such embodiments the fault determiner may be configured to determine that the presence sensor is at fault where it is unable to detect the object in range and thus did not control the luminaire to switch on (or off). Similarly other types of fault may be determined. For example where the sensor determiner indicates that the object is detected but the luminaire is not switched on or performs a defined action then a luminaire or controller fault may be generated. Similarly where the detection of the object causes a different luminaire to perform the defined action, such as switch on, then the fault may be an installation or commissioning fault.

The diagnostic apparatus may further comprise: a luminaire detector configured to detect the at least one luminaire based on at least one image received from a camera, wherein the fault determiner is further configured to determine the type of lighting system fault based on an output of the luminaire detector.

In such embodiments the luminaire detector may identify the luminaire being diagnosed. For example the luminaire detector may be configured to receive a positional or location estimate input for the object. The luminaire detector may then determine the luminaire which is expected to be associated with presence sensor with a sensing range comprising the positional estimate. Furthermore in some embodiments the luminaire detector may receive images from a camera or other imaging device and determine the luminaire based on a coded light signal. Thus by detecting the luminaires the fault determiner may be able to diagnose an installation or commissioning fault where the luminaire detected does not match the expected luminaire identifier.

The diagnostic apparatus may further comprising a light output characteristic determiner configured to measure at least one characteristic of the light output of the detected at least one luminaire further based on the at least one image received from the camera, wherein the fault determiner is further configured to determine the type of lighting system fault based on an output of the light output characteristic determiner.

In such embodiments the light output characteristic determiner may be configured to determine whether the luminaire is on or off, or is producing the desired or expected lighting effect or action and thus determine when the lighting system fault is a luminaire or controller fault.

The diagnostic apparatus may further comprise a diagnostic control module configured to generate a request to change at least one light output characteristic of the at least one luminaire; and wherein the fault determiner is further configured to determine the type of lighting system fault based on an output of the diagnostic control module.

In such embodiments the diagnostic control module may be configured to provide an input to the control system and thus determine whether there is a fault in the lighting system which is within the controller or luminaire functions.

The diagnostic control module may be configured to be controlled based on the at least one input to control the at least one luminaire.

In such embodiments the input received from the user input may be used to trigger the diagnostic control module to generate a suitable diagnostic command program for performing a detailed diagnostic operation on the lighting system.

The light output characteristic determiner may be further configured to measure at least one characteristic of the light output of the detected at least one luminaire before and after the request to change at least one light output characteristic of the at least one luminaire is implemented at the luminaire.

In such embodiments the light output characteristic determiner may be configured to provide an input to the fault determiner to determine whether the change in luminaire behavior is as expected.

The diagnostic apparatus may further comprise a transceiver configured to transmit the request to change at least one light output characteristic of the at least one luminaire to a lighting system manager, wherein the lighting system manager is configured to generate and execute a lighting system control for changing the at least one light output characteristic of the detected at least one luminaire based on the request.

The transceiver may be further configured to transmit the at least one fault report to a building management server.

The fault determiner may be configured to determine at least one lighting system commissioning fault based on the at least one input and wherein an object is within the sensing range of a presence sensor expected to be associated with the at least one luminaire when the presence sensor is determined to control a further luminaire other than the at least one luminaire expected to be associated with the presence sensor.

The diagnostic apparatus may be a personal control application.

The diagnostic apparatus may be a lighting system controller.

The diagnostic apparatus may be a building management system.

A lighting system may comprise: the diagnostic apparatus as discussed herein; at least one (intelligent) luminaire in communication with the diagnostic apparatus; and at least one presence sensor expected to be associated with the at least one (intelligent) luminaire.

The apparatus may be further caused to determine a status of the at least one presence sensor, wherein determining at least one lighting system fault may cause the apparatus to determine a type of lighting system fault based on a sensor determiner output and the at least one input.

The determining at least one lighting system fault may cause the apparatus to determine a presence sensor fault when the sensor determiner output fails to produce an output indicating the presence sensor, expected to be associated with the at least one luminaire, detects the object within the presence sensor sensing range.

The apparatus may be further caused to detect the at least one luminaire based on at least one image received from a camera, wherein determining at least one lighting system fault may cause the apparatus to determine the type of lighting system fault based on an output of the luminaire detector.

The apparatus may be further caused to measure at least one light output characteristic of the detected at least one luminaire further based on the at least one image received from the camera, wherein determining at least one lighting system fault may cause the apparatus to determine the type of lighting system fault based on an output of the light output characteristic determiner.

The apparatus may further be caused to generate a request to change at least one light output characteristic of the at least one luminaire; and wherein determining at least one lighting system fault may cause the apparatus to determine the type of lighting system fault based on an output of the diagnostic control module.

The generating a request to change at least one light output characteristic of the luminaire may be controlled based on the at least one input to control the at least one luminaire.

The measuring of at least one light output characteristic of the detected at least one luminaire may cause the apparatus to measure at least one characteristic of the detected at least one luminaire before and after the request to change at least one light output characteristic of the at least one luminaire is implemented at the luminaire.

The apparatus may further be caused to transmit the request to change at least one light output characteristic of the at least one luminaire to a lighting system manager, wherein the lighting system manager is configured to generate and execute a lighting system control for changing the at least one light output characteristic of the detected at least one luminaire based on the request.

The apparatus may be further caused to transmit the at least one fault report to a building management server.

The determining at least one lighting system fault may cause the apparatus to determine at least one lighting system commissioning fault based on the at least one input and wherein an object is within the sensing range of a presence sensor expected to be associated with the at least one luminaire when the presence sensor is determined to control a further luminaire other than the at least one luminaire expected to be associated with the presence sensor.

In some embodiments the diagnostic apparatus, comprises at least one camera configured to capture images of the lighting system comprising at least one luminaire to be diagnosed.

According to a second aspect there is provided a method for diagnosing faults within a lighting system comprising at least one luminaire, and at least one presence sensor configured to control the operation of at least one luminaire when an object is within the presence sensor sensing range, the method comprising: receiving, from a user input, at least one input to control the at least one luminaire; and determining at least one lighting system fault based on the at least one input and wherein an object is within the sensing range of a presence sensor expected to be associated with the at least one luminaire; and generating at least one fault report based on the determined at least one lighting system fault.

The method may further comprise determining a status of the at least one presence sensor, wherein determining at least one lighting system fault may comprise determining a type of lighting system fault based on a sensor determiner output and the at least one input.

The determining at least one lighting system fault may comprise determining a presence sensor fault when the sensor determiner output fails to produce an output indicating the presence sensor, expected to be associated with the at least one luminaire, detects the object within the presence sensor sensing range.

The method may further comprise detecting the at least one luminaire based on at least one image received from a camera, wherein determining at least one lighting system fault may comprise determining the type of lighting system fault based on an output of the luminaire detector.

The method may further comprise measuring at least one light output characteristic of the detected at least one luminaire further based on the at least one image received from the camera, wherein determining at least one lighting system fault may comprise determining the type of lighting system fault based on an output of the light output characteristic determiner.

The method may further be comprise generating a request to change at least one light output characteristic of the at least one luminaire; and wherein determining at least one lighting system fault may comprise determining the type of lighting system fault based on an output of the diagnostic control module.

The generating a request to change at least one light output characteristic of the luminaire may be controlled based on the at least one input to control the at least one luminaire.

The measuring of at least one light output characteristic of the detected at least one luminaire may comprise measuring at least one light output characteristic of the detected at least one luminaire before and after the request to change at least one light output characteristic of the at least one luminaire is implemented at the luminaire.

The method may further comprise transmitting the request to change at least one light output characteristic of the at least one luminaire to a lighting system manager, wherein the lighting system manager may generate and execute a lighting system control for changing the at least one light output characteristic of the detected at least one luminaire based on the request.

The method may further comprise transmitting the at least one fault report to a building management server.

The determining at least one lighting system fault may comprise determining at least one lighting system commissioning fault based on the at least one input and wherein an object is within the sensing range of a presence sensor expected to be associated with the at least one luminaire when the presence sensor is determined to control a further luminaire other than the at least one luminaire expected to be associated with the presence sensor.

According to a third aspect there is provided a computer program product comprising code embodied on one or more computer-readable storage media and/or being downloadable therefrom, and being configured so as when run on a diagnostic apparatus for diagnosing faults within a lighting system comprising at least one luminaire, and at least one presence sensor configured to control the operation of at least one luminaire when an object is within the presence sensor sensing range, the apparatus configured to perform operations of: receiving, from a user input, at least one input to control the at least one luminaire; and determining at least one lighting system fault based on the at least one input and wherein an object is within the sensing range of a presence sensor expected to be associated with the at least one luminaire; and generating at least one fault report based on the determined at least one lighting system fault.

As used herein for purposes of the present disclosure, the term "LED" should be understood to include any electroluminescent diode or other type of carrier injection/junction-based system that is capable of generating radiation in response to an electric signal and/or acting as a photodiode. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semiconductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above). A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The terms "lighting fixture" and "luminaire" are used interchangeably herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user" as user herein refers to any entity, human or artificial, that interacts with systems and methods described herein. For example, the term includes, without limitation, occupants of a space such as an office worker or visitor, remote users of a space, a facility manager, a commissioning engineer, a building IT manager, a service engineer, and an installer.

BRIEF DESCRIPTION OF THE DRAWINGS

To assist understanding of the present disclosure and to show how embodiments may be put into effect, reference will be made by way of example to the accompanying drawings in which.

DETAILED DESCRIPTION OF EMBODIMENTS

This invention uses the concept of placing diagnostic apparatus in the form of an observer or monitoring apparatus suitable to further control the light units or light sources within the lighting sources in order to determine any faults within the lighting system by observing the response to any defined controls passed to the light units or light sources. Furthermore the diagnostic apparatus may be configured to trigger the occupancy sensors and/or provide a suitable input for other lighting system sensors in order to observe the effect of the sensors on the lighting system.

Figure 1:
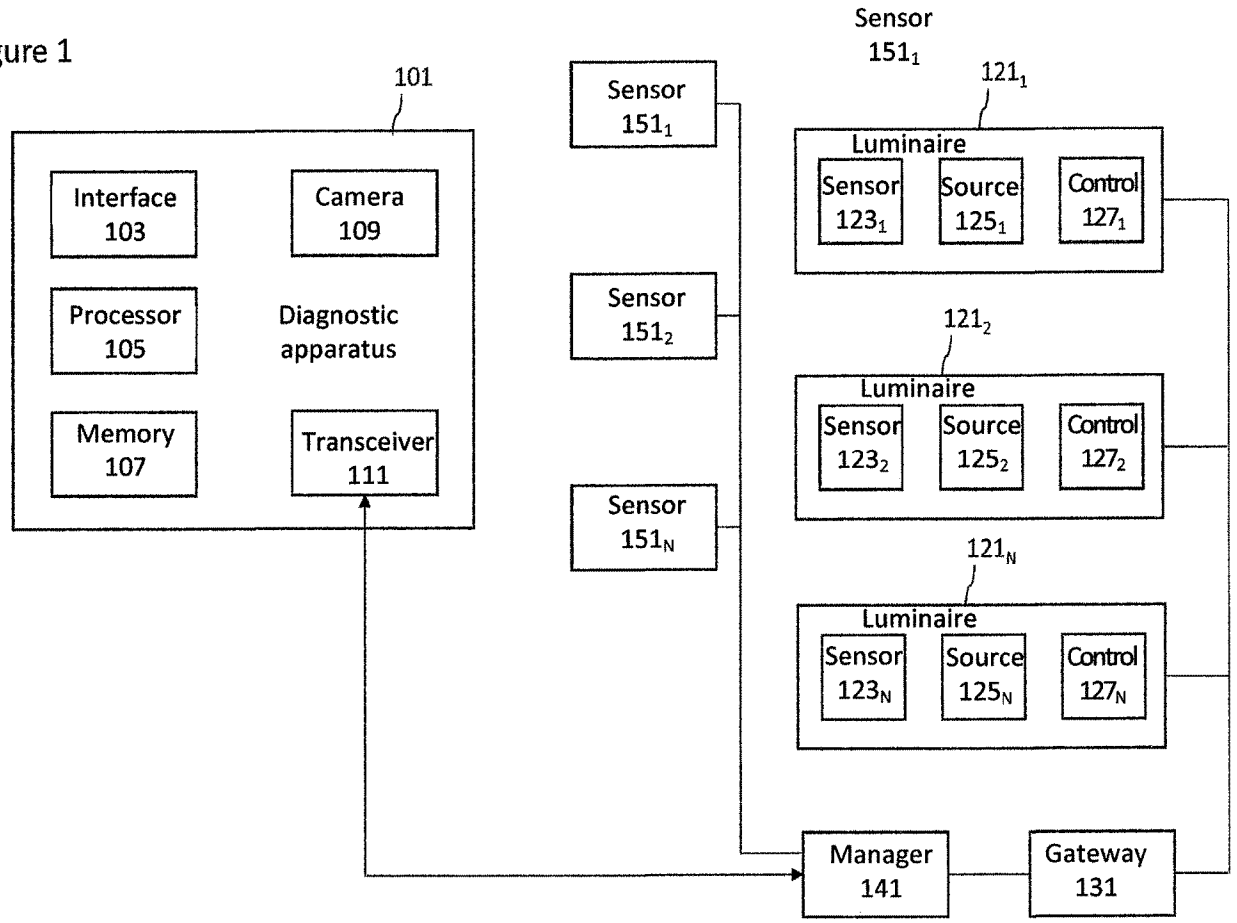
FIG. 1 is a schematic illustration of a lighting system comprising an intelligent luminaire environment suitable for implementing some embodiments.

With respect to FIG. 1 an example illustration of a lighting system is shown comprising an intelligent luminaire environment and a diagnostic apparatus suitable for implementing some embodiments.

The diagnostic apparatus 101 in some embodiments may be a mobile phone or smartphone which may be carried and operated by a user. In some embodiments the diagnostic apparatus 101 may also be implemented, without limitation, within computing devices such as tablet or handheld computing devices, laptop computers, touch sensitive and/or voice activated input and/or display devices communicatively connected to one or more processors, and desktop computing devices. In some embodiments the diagnostic equipment may be an autonomous or semi-autonomous apparatus. For example the diagnostic apparatus may be mounted or carried by a tracked or wheeled chassis and be configured to follow a defined or otherwise chosen path through the lighting system space. In some embodiments the diagnostic apparatus 101 may be mounted on a flying structure, for example a lighter-than-air 'drone' or helicopter or quadcopter 'drone' and fly through the space performing a diagnostic analysis of the lighting system. In the following examples the diagnostic apparatus and the object which is detected by the presence sensor as discussed herein are the same apparatus. However in some embodiments the diagnostic apparatus may implemented within a controller or building system manager apparatus. Furthermore the following examples describe the diagnostic apparatus 101 as being a single physical device or apparatus. However in some embodiments the diagnostic apparatus 101 may be implemented as parts (or components or modules) operating on physically separate devices and configured to communicate with other parts.

The diagnostic apparatus 101 may comprise a user interface 103. The user interface 103 enables a user to input commands to the diagnostic apparatus 101, for example via a keypad, and/or to obtain information from the diagnostic apparatus 101, for example via a display. In some embodiments a touch screen may provide both input and output functions for the user interface. For example the user interface 103 may be used by the user to initiate a diagnostic application or program to be performed on the diagnostic apparatus 101. Furthermore the user interface 103 may be used to display the results of the diagnostic application or program, for example to display a report indicating whether a sensor or luminaire within the lighting system has failed.

The diagnostic apparatus 101 may comprise at least one processor or CPU 105. The processor 105 can in some embodiments be configured to execute various program code or applications. The implemented program codes or programs may be for example luminaire/sensor identification code, luminaire control code, luminaire monitoring code and luminaire fault diagnosis code as described herein. The implemented program codes can in some embodiments be stored for example in a memory 107 for retrieval by the processor 105 whenever needed.

The luminaire/sensor identification code, luminaire control code, luminaire monitoring code and luminaire fault diagnosis code may in some embodiments be implemented at least partially in hardware and/or firmware.

The diagnostic apparatus 101 may comprise a memory 107. The memory 107 may comprise a section or part configured, as described herein, to store program codes. The memory 107 may furthermore provide a section or part for storing data, for example sensor data received from the lighting system, observed lighting system data, or lighting system control signal data in accordance with the application as described herein. In some embodiments, such as described above, the user interface 103 is a physically separate device or module from the CPU 105 and memory 107. For example the user interface 103 may be a mobile device or user equipment running a luminaire control application and configured to communicate with a control or management server implementing the CPU 105 and memory 107 configured to execute the diagnostic module program described herein.

The diagnostic apparatus 101 may comprise a camera 109. The camera 109 may be any suitable digital camera or imaging device. In some embodiments the camera 109 may capture image data for wavelengths outside of the normal visible range, for example infra-red wavelengths.

The diagnostic apparatus 101 may comprise a transceiver 111. The transceiver 111 may be suitable for enabling communication with other apparatus, for example the lighting system via a wireless communication network. The transceiver 111 can communicate with other apparatus by any suitable known communications protocol, for example in some embodiments the transceiver 111 or transceiver means can use a suitable universal mobile telecommunications system (UMTS) protocol, a wireless local area network (WLAN) protocol such as for example IEEE 802.X, a suitable short-range radio frequency communication protocol such as Bluetooth, ZigBee or infrared data communication pathway (IRDA).

The lighting system shown in FIG. 1 further comprises at least one controllable luminaire or intelligent luminaire 121. In the example shown in FIG. 1 there are shown three intelligent luminaires $\mathbf{121}_1$, $\mathbf{121}_2$, $\mathbf{121}_N$.

Each of the intelligent luminaires 121 may comprise a sensor 123, a light source 125, and a control module with transceiver capability 127. In some embodiments the sensor 123 and light source 125 are located within the same device or housing.

The sensor 123 may be a sensor capable of sensing, for example, one or more of daylight, occupancy, IR, carbon dioxide, humidity and temperature.

The light source 125 may be capable of performing one or more light actuating functions, such as turning on/off, dimming, and tuneable white light or colored light production. The light source 125 may be any one or more of a variety of radiation sources, including, but not limited to, LED-based sources (including one or more LEDs as defined above). A given light source may be configured to generate electromagnetic radiation within the visible spectrum, outside the visible spectrum, or a combination of both. Hence, the terms "light" and "radiation" are used interchangeably herein. Additionally, the light source 125 may include as an integral component one or more filters (e.g., color filters), lenses, or other optical components. Also, it should be understood that the light source 125 may be configured for a variety of applications, including, but not limited to, indication, display, and/or illumination.

In some embodiments the control module 127 comprises computer code (e.g. software or microcode) executing on one or more processors housed within the same device or housing as the sensor 123 and/or light source 125. The control module 127 may provide one or more control functions for controlling the behavior of other modules and devices, such as one or more of the light source 125 and the sensor 123.

The intelligent luminaire 121, and in some embodiments the control module 127 may provide one or more external interfaces for communicating with other modules of the lighting system. The interface may be any suitable interface. For example the interface may be an EnvisionIP interface or other suitable interface for use in commissioning the light source 125 and/or for use by control module 127 to influence the behavior of other luminaires and sensors communicatively connected to itself. In some embodiments the intelligent luminaire 121, and specifically the control module 127, may also provide an xCLIP interface or other suitable interface for use by control module 127 to access and control basic capabilities of light source 125 or other light sources communicatively connected to the luminaire 121. The xCLIP interface may also be used by other system modules (e.g. gateway module 130) for accessing sensor data generated by sensors accessible to the luminaire 121, and energy consumption and diagnostic data available to the light source 125.

The intelligent luminaires such as the ones shown in FIG. 1 $\mathbf{121}_1$, $\mathbf{121}_2$, and $\mathbf{121}_N$ may each generate coded light signals comprising codes identifying themselves (and/or other associated light sources. In some embodiments each intelligent luminaire 121 is configured to transmit the coded light signal comprising the code identifying itself to the manager module 141 and/or the diagnostic apparatus 101.

The lighting system in some embodiments may further comprise a manager module 141. The manager module 141, executing on one or more processors, may be configured to receive one or more signals comprising a control request from the diagnostic apparatus 101, and generate a control command. In some embodiments, the control command comprises the information encoded in the control request, but in a format understandable by a gateway module or commissioned units (e.g. IP luminaire) to which it is transmitted. Furthermore, while the control request may contain more general information regarding desired changes in a particular room or work zone, the control command may be more specific with regard to the implementation of the requested changes encoded in the control request. For example, the control command may contain specific instructions that, when processed by a group of intelligent luminaires, cause the luminaires to effect specific changes in illumination. The manager module 141 thereafter may transmit, the control command to a gateway module 131.

The lighting system in some embodiments may furthermore comprise a gateway module 131. The gateway module 131 may store data associated with the control command, such as identification information associated with the luminaire(s) that will respond to the desired change in lighting level. The gateway module 131 may then communicate with the intelligent luminaire 121 to adjust their illumination to produce the light level requested.

The lighting system in some embodiments may furthermore comprise sensors 151. The sensors 151, may be any suitable sensor configured to produce data indicative of, for example, motion, occupancy, sound, the presence of one or more gases, illumination, humidity, and temperature. The sensors, of which three $\mathbf{151}_1$, $\mathbf{151}_2$, and $\mathbf{151}_N$ are shown in FIG. 1 may communicate with the manager module 141 (and from there to the diagnostic apparatus 101) or with an associated intelligent luminaire 121 or directly with the diagnostic apparatus 101.

Figure 2:
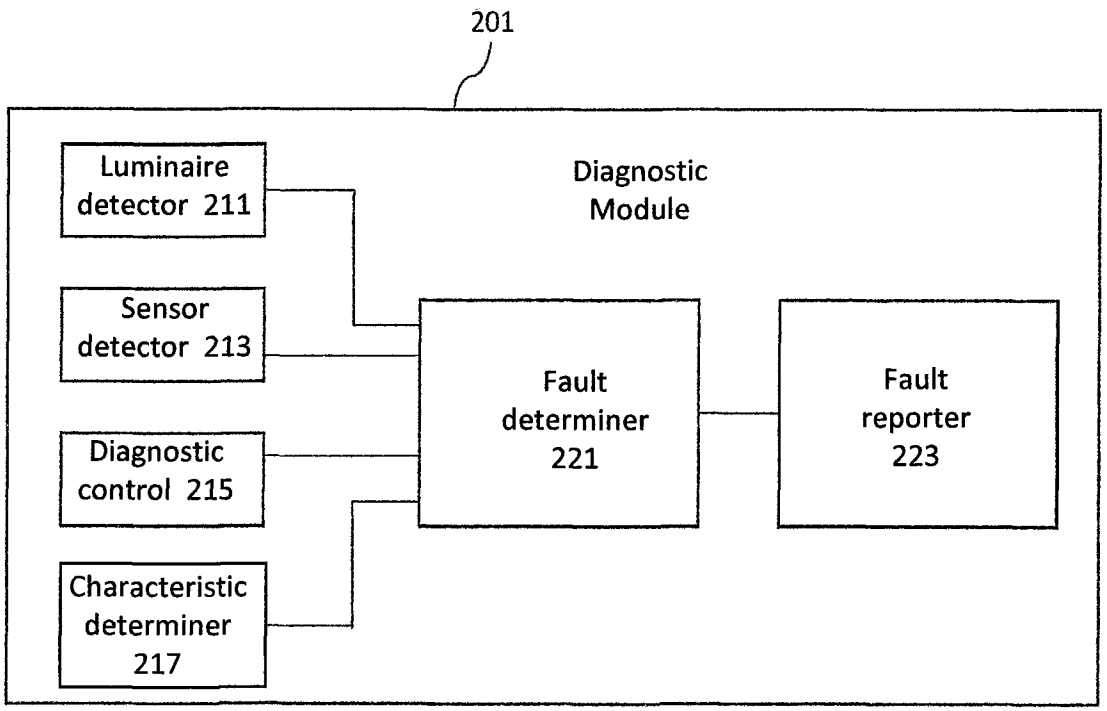
FIG. 2 is a schematic block diagram of a lighting system diagnostic apparatus such as shown in FIG. 1 according to some embodiments.

With respect to FIG. 2 a schematic block diagram of a diagnostic module is shown. The diagnostic module 201 may in some embodiments be implemented within program code or otherwise stored on memory 107 and executed on the processor 105 within the diagnostic apparatus 101 such as shown in FIG. 1. In some embodiments the diagnostic module 201 may be implemented at least partially in hardware or as a combination of software and hardware.

The diagnostic module 201 may in some embodiments be configured to be connected or communicate with the camera module 109 and thus receive image or data from the camera module. Furthermore the diagnostic module 201 may be configured to communicate with the transceiver 111 and thus be configured to generate and pass control requests to the manager module 141. As described herein the manager module 141 may then be configured to convert the requests into control commands which are passed to the intelligent luminaires 121 via the gateway 131.

The diagnostic module 201, configured to communicate with the transceiver 111 may further be configured to furthermore receive data from the manager module 141. For example the manager module 141 may be configured to pass sensor information from a sensor 151 or an intelligent luminaire 121 sensor 123.

The diagnostic module 201 may furthermore be configured to communicate with the user interface 103, for example to receive inputs to start a diagnostic process or to receive a user command to effect a change in at least one of the luminaires. Similarly the diagnostic module 201 may be configured to generate an output to the user interface to display to the user, for example to display a message indicating a faulty sensor or light source.

The diagnostic module 201 may in some embodiments comprise a luminaire detector 211. The luminaire detector 211 in some embodiments is configured to receive the output from the camera 109 and detect a coded light signal generated by a specific luminaire. In some embodiments the coded light signal is then used to identify the luminaire currently in 'view'. The luminaire detector 211 may in some embodiments look up the detected coded light signal from the code passed to it from the intelligent luminaire, or communicate with the manager module 141 which identifies the luminaire in view from the stored code list stored on the manager module 141.

In some embodiments the luminaire detector 211 may be configured to receive an output from a position or location detector. The position or location detector may for example be a beacon based location determiner configured to determine the location of the diagnostic apparatus based on received signals (such as GPS, cellular mobile). In some embodiments the position or location detector may receive outputs from other internal sensors (such as compass or gyroscopes) for enabling dead reckoning positional estimations. From the positional information and furthermore from knowledge of the orientation of the apparatus (and thus the orientation of the camera) the luminaire detector 211 may be configured to use the installation or other lighting plan to determine which luminaire is in 'view' of the camera 109.

In some embodiments the diagnostic module 201 comprises a sensor detector 213. The sensor detector 211 may receive the output of the luminaire detector 211 and using a lighting system commissioning plan or other plan of the lighting system determine whether the luminaire detected by the luminaire detector 211 is physically associated with a sensor. In some embodiments the sensor detector may be configured to determine the status of a sensor, such as a presence sensor, which is expected to be associated with a luminaire. The status of a sensor may be an indication on whether the sensor is operating (or switched on). The status of the sensor may furthermore be an indication of the output of the sensor. For example whether a proximity sensor has detected an object within its sensing range. The luminaire may for example be a luminaire for which a user input has been received in order that a fault determiner may be configured to determine whether there is a fault associated with a sensor, a luminaire, or whether the expected association is at fault (for example whether there is an installation or commissioning fault).

For example in some embodiments the luminaire 121 comprises a sensor 123 or may be positioned nearby or logically associated with a sensor 151. In some embodiments the sensor detector 213 is configured to communicate with the manager module 141 to retrieve sensor data from the detected sensors. In other words the sensor detector 213 may be configured to retrieve sensor data from the associated (physically or logically) sensors. In some embodiments the sensor detector may be configured to receive all of the sensor outputs and configured to select or filter the sensor output data based on the detected coded light signal. In such a manner the sensors which are associated (either physically or logically) with the detected light sources.

In some embodiments the diagnostic module 201 comprises a light characteristic adjuster, or diagnostic control module 215. The diagnostic control module 215 may be configured to receive from the luminaire detector 211 the detected luminaire information. The diagnostic control module 215 may be configured to generate control requests for the detected luminaire. These requests may be passed to the transceiver 111 and forwarded to the manager 141 before being converted into a suitable command for passing to the detected luminaire.

In some embodiments the diagnostic module 201 may comprise a light characteristic detector/determiner 217. The light characteristic detector/determiner 217 may be configured to receive images from the camera and determine a suitable light source characteristic. The light source characteristic may be any suitable characteristic determinable from the images captured by the camera. For example the characteristic may be one of: light source on/light source off; light source light level; light source color; light source color temperature; light source frequency; light source configuration.

The diagnostic module 201 may further comprise a fault determiner 221. The fault determiner 221 may be configured to communicate with the luminaire detector 211 and receive information as to which luminaires are 'in view' of the camera and thus able to be diagnosed. Furthermore the fault determiner 221 may be configured to communicate with the sensor detector 213 and receive information on the sensors 'in view' or from which sensors which can detect the diagnostic apparatus 101. The fault determiner 211 may be configured to communicate with the diagnostic control module 215 and receive information as to which control requests have been issued. The fault determiner 221 may furthermore be configured to communicate with the light characteristic detector/determiner 217 and furthermore receive information as to the current detected characteristics of the luminaire 'in view'. In some embodiments the fault determiner 221 may be configured to receive an input from the user interface 103.

The fault determiner 221 is configured to use this information to determine whether there are any faults in the detected luminaire and the associated sensors. The operation of the fault determiner 221 is described in further detail hereafter.

For example in some embodiments the fault determiner may be configured to determine or diagnose a fault within the lighting system comprising the luminaire and the sensor (operating as a presence sensor). The sensor operating as a presence sensor may be configured to control the operation of the luminaire when an object is within the presence sensor sensing range. The fault determiner may in such embodiments determine that there is a lighting system fault based on receiving the at least one input (for example an input requesting the luminaire to be switched on) and having knowledge that there is an object is within the sensing range of the presence sensor expected to be associated with the luminaire. In other words expecting the luminaire should be on based on the knowledge of the object within the sensing range and then receiving a user input requesting the light to be switched on enables the fault determiner to determine that there is a fault as the two events should not occur together without some fault in the lighting system occurring. This fault determination may be improved or the diagnosis detail improved by using further inputs such as the images from a camera enabling luminaire parameters to be measured or determined. Furthermore in some embodiments the fault determiner may receive outputs from the luminaire determiner positively identifying the luminaire. The fault determiner may further receive outputs from the sensor determiner providing further information enabling the sensor status to be analyzed. The fault determiner may furthermore receive outputs from the diagnostic control module and thus determine faults by observing changes in the luminaire.

The diagnostic module 201 may further comprise a fault reporter 223. The fault reporter may be configured to communicate with the fault determiner 221 to receive information about any determined faults in the detected luminaires and the associated sensors. The fault reporter 223 may furthermore be configured to compile a report comprising all of the determined faults. The fault reporter 223 may be configured to communicate with the user interface 109 and display information on the reported faults in the luminaires and associated sensors. Furthermore the fault reporter 223 may be configured to communicate with the manager 141 or similar building management server via the transceiver 111 to transmit the fault report.

Figure 3:
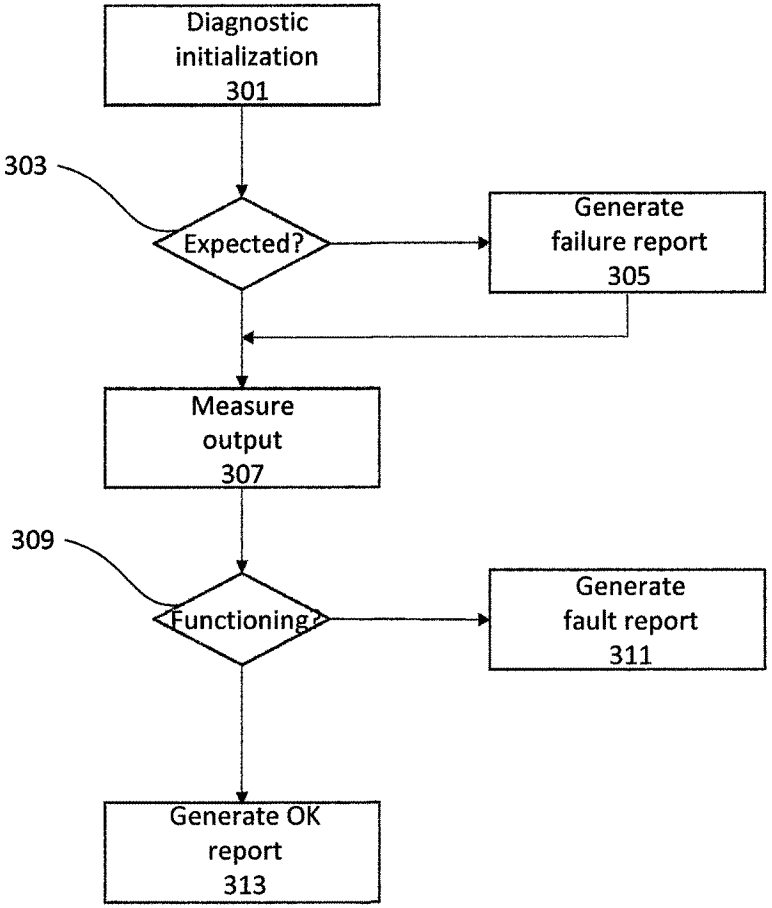
FIG. 3 shows a flow diagram of an overview of a lighting system diagnostic method according to some embodiments.

With respect to FIG. 3 a flow diagram of an overview of the lighting system diagnostic method according to some embodiments is shown.

The diagnostic apparatus when implementing the diagnostic module may be configured to initialize a diagnostic process or method. The initialization of the diagnostic process may be implemented based on a positive determination or detection of a luminaire (for example by the luminaire detector 211). In some embodiments the initialization of the diagnostic process may further comprise the detection or determination (using the sensor detector 213) of a sensor and sensor data (which may associated with the detected luminaire. In some embodiments the initialization of the diagnostic process may further comprise the generation (using the diagnostic control module 215) of a request to change a light characteristic of the detected luminaire. In some embodiments the initialization of the diagnostic process may further comprise the detection or determination (using the light characteristic detector 217) of light source characteristics for the detected luminaire prior to the transmission of the characteristic change request (in other words the 'original' or prior state of the luminaire).

The performing a diagnostic initialization is shown in FIG. 3 by step 301.

The diagnostic apparatus, using the fault determiner 221, may then be configured to compare the output of the associated sensor against an expected sensor output when the apparatus is 'within range' of the sensor. For example where a sensor 151 or 123 is an occupancy sensor and the diagnostic apparatus detects the associated intelligent luminaire 121 it is expected that the sensor would be triggered to indicate occupancy.

The operation of determining whether the sensor is performing according to the expected behavior, such as the triggering of the occupancy sensor, is shown in FIG. 3 by step 303.

Where the sensor does not produce the expected result, such as not indicating that the area is occupied for an occupancy sensor, then the diagnostic module 201 may be configured to generate a fault report. For example the fault determiner 221 may be configured to pass this information to a fault reporter 223 which generates a suitable sensor fault report identifying the fault in the sensor and outputs this report or message to a suitable output.

The operation of generating a sensor failure report is shown in FIG. 3 by step 305.

Furthermore in some embodiments the diagnostic module 201, and specifically the light characteristic determiner 217, may be configured to determine a further characteristic of the luminaire following the transmission and execution of the characteristic change request. In other words a further measurement of the detected luminaire output is performed.

The operation of further measuring the luminaire output is shown in FIG. 3 by step 307.

The diagnostic module 201, and in some embodiments the fault determiner 221, may be configured to compare the before and after light characteristics and furthermore compare the after light characteristics against an expected light characteristic to determine whether or not the intelligent luminaire is functioning correctly. Thus for example does the fault determiner 221 detect whether all the cups/ledstrings illuminated? If not which of the cups/ledstrings are failing to illuminate? Similarly does the fault determiner 221 detect that the light levels are similar across cups/ledstrings or do the levels differ by more than a determined threshold difference when the light levels should be similar according to the light source characteristic request. Does the fault determiner 221 determine whether any of the light sources are producing a visible flicker or operating at a frequency other than the requested frequency? Where the fault determiner 221 is configured to detect color errors, in other words the light source characteristic request is for a specific color, is the measured color correct? Or is there a color consistency between cups/ledstrings which is greater than an expected difference. In some embodiment dynamic light characteristic faults may be detected by comparing the change in the light characteristic between the initial and the further requests. In such embodiments the fault determiner 221 may be configured to verify whether a dimming or brightening effect is acceptable and compare the measured dimming or brightening against an expected dim curve. The fault determiner 221 may further may be configured to determine the smoothness of the dynamic light characteristic. Furthermore the nature of the dynamic light characteristic may be determined, for example whether the dimming or color change is a linear, or non-linear (for example logarithmic). The fault determiner 221 may also be configured to compare a measured fade time against an expected fade time.

As well as determining luminaire performance faults the fault determiner may be configured to detect commissioning errors. For example in some embodiments the luminaire detector 211 information may be passed to the fault determiner indicating an expected lamp type, whereas the light characteristic determiner 217 may determine from the camera image the actual lamp type and configuration. The fault determiner may then be configured to verify the lamp type (2×2×4, 4×4 etc.) for the detected luminaire. Furthermore commissioning errors such as logical errors may be detected by the fault determiner wherein whether the luminaire to be controlled is the correct one? (For example a light unit is detected which is 'luminaire A' to which a request is generated and fails to respond but instead a neighboring luminaire 'luminaire B' responds.

The operation of determining whether the luminaire is functioning correctly based on the measured light characteristics is shown in FIG. 3 by step 309.

Where the measured light characteristics are determined to indicate that the luminaire is not functioning correctly then the diagnostic module 201, and in some embodiments the fault reporter 223, may be configured to generate a suitable luminaire fault report indicating how the luminaire has failed.

The diagnostics report/dataset may in some embodiments be communicated to a buildings management server (BMS) or similar. In some embodiments the report/dataset can comprise data such as: Luminaire ID; Diagnostics results for the diagnostics that can be executed on the diagnostic apparatus (for example in some embodiments the apparatus may not hold all the required information to determine whether a test has passed such as: lamp type was detected, but the apparatus does not know whether that lamp type was expected at that position).

In some embodiments the fault determiner/fault reporter may be configured to output data to be analyzed on the BMS. Similarly in some embodiments the fault determiner/fault reporter may be configured to cache raw data (light characteristics, sensor information etc.) and send this raw data to a BMS on request.

The operation of generating a luminaire fault report is shown in FIG. 3 by step 311.

Where the luminaire is determined to be ok and functioning correctly then in some embodiments the diagnostic module, and in some embodiments the fault reporter 223, may be configured to generate an 'OK' luminaire function report providing a positive indication that the luminaire at a specific time was functioning correctly. Thus in some embodiments in later performances of the diagnostic apparatus it may be possible to indicate patterns of failures knowing when the luminaire or sensor failed more accurately.

The operation of generating a luminaire 'ok' report is shown in FIG. 3 by step 313.

Figure 4:
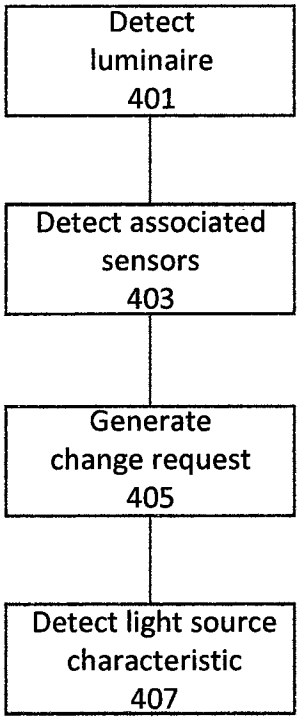
FIG. 4 shows a flow diagram of a lighting system diagnostic method initialization and measurement operations in further detail according to some embodiments.

With respect to FIG. 4 an example diagnostic initialization operation such as shown in FIG. 3 by step 301 is shown in further detail.

The initialization of the diagnostic process may be implemented based on a positive determination or detection of a luminaire (for example by the luminaire detector 211). For example in some embodiments the luminaire detector 211 is configured to receive the image data from the camera and detect which luminaires are in 'view' of the diagnostic apparatus based on the coded light from the luminaire detected from the image.

The operation of detecting from the coded light the luminaire is shown in FIG. 4 by step 401.

In some embodiments the initialization of the diagnostic process may further comprise the detection or determination (using the sensor detector 213) of a sensor and sensor data (which may associated with the detected luminaire. In other words having determined a luminaire the sensor detector 213 is configured to determine whether any associated sensors. In some embodiments the sensor detector 213 may furthermore be configured to determine or retrieve sensor information from the detected sensor in order that the sensor operation may be diagnosed by the fault determiner 221.

The operation of detecting the associated sensors, based on the detected luminaire is shown in FIG. 4 by step 403.

In some embodiments the initialization of the diagnostic process may further comprise the generation (using the diagnostic control module 215) of a request to change a light characteristic of the detected luminaire. This may be any suitable change in characteristic, such as light level, color, temperature, light source configuration, frequency etc.

The operation of generating the request to change the characteristic of the detected luminaire is shown in FIG. 4 by step 405.

In some embodiments the initialization of the diagnostic process may further comprise the detection or determination (using the light characteristic detector 217) of light source characteristics for the detected luminaire prior to the transmission of the characteristic change request (in other words the 'original' or prior state of the luminaire). This may for example be performed by using the images captured by the camera in the time period prior to the transmission or execution of the light characteristic change request.

The operation of detecting an initial light source characteristic is shown in FIG. 4 by step 407.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A diagnostic apparatus for diagnosing a fault within a lighting system, the lighting system comprising a luminaire and a presence sensor, wherein the presence sensor is configured to control a light output characteristic of the luminaire based on detecting an object within a sensing range, the diagnostic apparatus comprising:

an interface configured to receive, from a user, an input to control the luminaire, wherein the received input is indicative of the user being within the sensing range of the presence sensor, a fault determiner configured to determine a lighting system status and a lighting system fault, wherein the lighting system fault is based on the received input and the determined lighting system status, a fault reporter configured to generate a fault report based on the determined lighting system fault; and a sensor determiner configured to determine a status of the presence sensor, wherein the fault determiner is configured to determine the lighting system status based on receiving the status of the presence sensor, and further configured to determine a type of lighting system fault based on the lighting system status and the received input; and wherein the fault determiner is configured to determine a presence sensor fault when the sensor determiner output fails to produce an output indicating the presence sensor detecting an object indicative of the user being within the sensing range.

2. The diagnostic apparatus as claimed in claim 1, further comprising:

a luminaire detector configured to detect the luminaire based on an image received from a camera, wherein the fault determiner is further configured to determine the type of lighting system fault based on an output of the luminaire detector.

3. The diagnostic apparatus as claimed in claim 2, further comprising a light output characteristic determiner configured to measure a light output characteristic of the detected luminaire based on the image received from the camera, wherein the fault determiner is further configured to determine the type of lighting system fault based on an output of the light characteristic determiner.

4. The diagnostic apparatus as claimed in claim 1, further comprising a diagnostic control module configured to generate a request to change a light output characteristic of the luminaire; and wherein the fault determiner is further configured to determine the type of lighting system fault based on an output of the diagnostic control module.

5. The diagnostic apparatus as claimed in claim 4, wherein the diagnostic control module is configured to be controlled based on the input received from the user to control the luminaire.

6. The diagnostic apparatus as claimed in claim 4 wherein the light output characteristic determiner is further configured to measure a characteristic of the luminaire before and after the request to change a characteristic of the luminaire is implemented at the luminaire.

7. The diagnostic apparatus as claimed in claim 4, further comprising a transceiver configured to transmit the request to change a light output characteristic of the luminaire to a lighting system manager, wherein the lighting system manager is configured to generate and execute a lighting system control for changing the light output characteristic of the detected luminaire based on the request.

8. The diagnostic apparatus as claimed in claim 7, wherein the transceiver is further configured to transmit the fault report to a building management server.

9. The diagnostic apparatus as claimed in claim 1, wherein the fault determiner is configured to determine a lighting system commissioning fault when the presence sensor is determined to control a further luminaire.

10. The diagnostic apparatus as claimed in claim 1, wherein the diagnostic apparatus is a mobile phone.

11. A lighting system comprising:

the diagnostic apparatus as claimed in claim 1, a luminaire in communication with the diagnostic apparatus; and a presence sensor associated with the luminaire.

12. The diagnostic apparatus as claimed in claim 1, wherein the fault determiner is configured to determine the presence sensor fault on condition that: the sensor determiner output fails to produce the output indicating the presence sensor detecting the object indicative of the user being within the sensing range when the diagnostic apparatus detects the received input.

13. A method of for diagnosing faults within a lighting system, the lighting system comprising a luminaire and a presence sensor, wherein the presence sensor is configured to control a light output characteristic of the luminaire based on detecting an object within a sensing range, the method comprising:

receiving, via an interface, from a user, an input to control the luminaire, wherein the received input is indicative of the user being within the sensing range of the presence sensor, and determining a lighting system status and a lighting system fault, wherein the lighting system status is based on receiving the status of the presence sensor and wherein the lighting system fault is based on the received input and the determined lighting system status, generating a fault report based on the determined lighting system fault; and wherein the method further comprises:

determining a type of lighting system fault based on the lighting system status and the received input, and determining a presence sensor fault when a sensor determiner output fails to produce an output indicating the presence sensor detecting an object indicative of the user being within the sensing range.

14. A computer program product comprising code embodied on one or more computer-readable storage media and/or being downloadable therefrom, and being configured to perform the method according to claim 13 when run on a diagnostic apparatus for diagnosing faults within a lighting system.

15. The method as claimed in claim 13, wherein the determining the presence sensor fault is performed on condition that: the sensor determiner output fails to produce the output indicating the presence sensor detecting the object indicative of the user being within the sensing range when the method detects the received input.

* * * * *